United States Patent [19]

Köbler

[11] Patent Number: 5,029,843

[45] Date of Patent: Jul. 9, 1991

[54] PRINTED PRODUCTS HANDLING APPARATUS FOR RECEPTION, STORAGE AND TRANSFER OF FOLDED SHEET PRODUCTS

[75] Inventor: Ingo Köbler, Anhausen, Fed. Rep. of Germany

[73] Assignee: Man Roland Druckmaschinen AG, Offenbach am Main, Fed. Rep. of Germany

[21] Appl. No.: 486,091

[22] Filed: Feb. 28, 1990

[30] Foreign Application Priority Data

Mar. 15, 1989 [DE] Fed. Rep. of Germany ..... 3908347

[51] Int. Cl.[5] ..... B65H 29/04

[52] U.S. Cl. ..... 271/204; 271/184; 271/207; 271/216; 198/347.3; 198/778; 221/217

[58] Field of Search ..... 271/82, 84, 85, 184, 271/185, 198, 199, 204, 205, 206, 207, 277, 216; 198/347.3, 778, 803.9; 221/217, 218, 219

[56] References Cited

U.S. PATENT DOCUMENTS

| | | | |
|---|---|---|---|
| 4,509,703 | 4/1985 | Grunder | 198/347.3 X |
| 4,605,212 | 8/1986 | Kobler | 271/69 X |
| 4,893,805 | 1/1990 | Eberle | 271/207 X |
| 4,896,870 | 1/1990 | Kobler | 271/216 X |

FOREIGN PATENT DOCUMENTS 2335358 1/1974 Fed. Rep. of Germany .

*Primary Examiner*—Joseph E. Valenza
*Assistant Examiner*—Tuan N. Nguyen
*Attorney, Agent, or Firm*—Frishauf, Holtz, Goodman & Woodward

[57] ABSTRACT

To hold and transport folded printed products, a belt (18), for example a steel ribbon, has separating and holding elements (19), for example flat metal plates or sheets secured thereto. The transport belt (18) with the separating elements thereon is guided about a curved guide surface (20), for example a roller, whereupon the separating elements will spread or fan out from the underlying transport belt. In this spread or fanned out position, they can accept one sheet element (11) of a spread apart folded product (1), the separating element (19) gripping that sheet element (11) between itself and the transport belt. The folded products can then be transported, in scale-like or imbricated or shingled form, to a storage position, for example by rolling up the steel ribbon (18). The folded products are released be again passing the belt about a curved directing surface (26) which may again be a roller or the same roller, which will again fan out the separating elements, spreading them from the transport belt (18) for release of the folded products, for example for placement on a saddle or other support structure where they are held suspended from beneath the bend or fold thereof.

13 Claims, 6 Drawing Sheets

PRINTED PRODUCTS HANDLING APPARATUS FOR RECEPTION, STORAGE AND TRANSFER OF FOLDED SHEET PRODUCTS

Reference to related patents, assigned to the assignee of the present application, the disclosures of which are hereby incorporated by reference:

U.S. Pat. No. 4,605,212, Kobler.

U.S. Pat. No. 4,896,870, Kobler, based on application Ser. No. 07/344,472, filed Apr. 26, 1989, to which German Patent No. 36 43 026 corresponds.

The present invention relates to a system for receiving, storing and transferring folded sheet products, and more particularly printed products, as derived from paper handling apparatus associated with a printing machine.

BACKGROUND

U.S. Pat. No. 4,896,870, Kobler, describes an apparatus in which elements to open folded products are introduced between the fold. A transport device has separating elements which can receive the folded products, the separating elements being introduced into spread sheet elements or halves of the folded products. When the folded products are to be released, the spreading or separating elements are again removed.

The referenced patent describes an arrangement in which the folded products have separating elements introduced therein, which are wider than the folded products themselves. The arrangement permits the folded products to be spread out in a linear path, to be received by a transport apparatus, and subsequently assembled, for example in a storage roll. The carriers which form the separating elements are deformed in this arrangement.

THE INVENTION

It is an object to simplify separation of adjacent sheets of folded products for reception, storage or transfer which is simpler than that previously proposed, in which folded products, without an in-turned edge, can be easily received, stored and again released; and in which the separating elements or transfer elements do not necessarily have to be wider than the folded products themselves.

Briefly, a plurality of essentially flat separating elements are provided, secured to a transport belt which holds them in coupled, connected relation, aligned along the length of the transport belt. The term "belt" as used herein refers to any linear, flexible element, and may, for example, be a strip of sheet steel. The transport belt is guided around a curved guide, so that the separating elements which, formerly, were flat against the transport belt, will fan out. The folded products are guided towards the curved guide element so that the fanned separating elements can be introduced between the spread-apart sheets of the folded products and, when the separating elements are again against the belt, the separating elements together with the belt will function as grippers. This fanning out, introduction, and gripping is carried out while the transport belt moves. The transport belt, with the thus gripped folded products, can then be rolled up, for example to form a storage roll.

To release the sheets, the transport belt is again guided over a curved directing element, positioned for engagement with the transport belt which, then, will again fan or spread out the separating elements. The separating elements, no longer placed against the transport belt with the sheets therebetween, will release the sheets. One of the sheets will still be held on the transport belt as it passes over the curve directing element, the other sheet flying away, upon motion, to permit introduction of a subsequent separating element if this is desired, or a subsequent transport apparatus. Upon further movement of the belt about the directing element, the initially gripping separating element will release the first, previously gripped sheet.

The overall system, including a first or loading subsystem and a second, or unloading subsystem, with the belt also forming part of a storage device, have the advantage that the separating element need not be wider than the folded product and, rather, may be of the same size or narrower.

DRAWINGS

DETAILED DESCRIPTION

Figure 4:
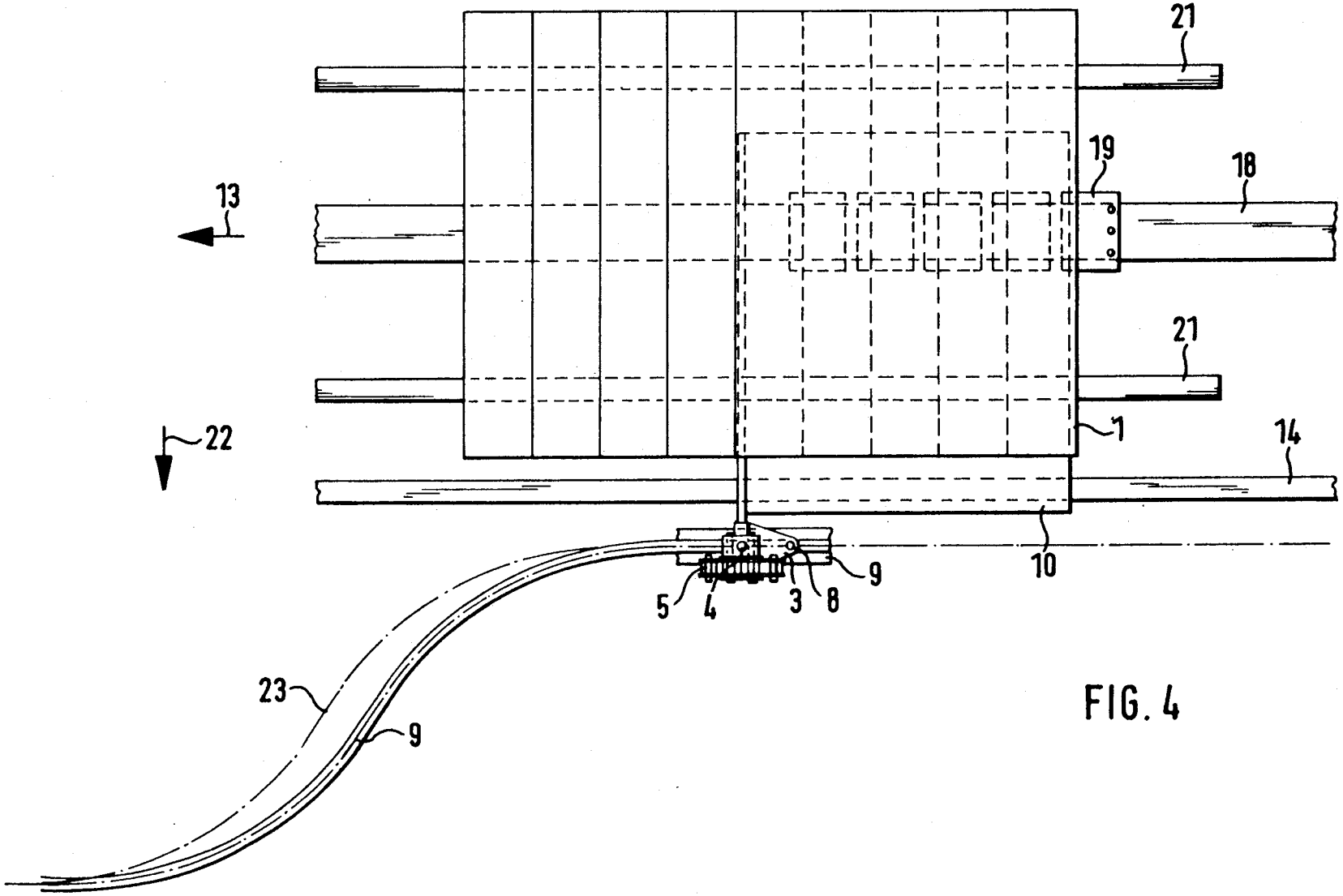
FIG. 4 is a top view of the apparatus of FIG. 2.

Folded products 1 are supplied to the apparatus while hanging from a hanger structure, including hanger rods 2. The folded products need not have any edge folds or side folds or over-folds. The rods 2 are pivotably secured for pivoting about a pin 4 in guide blocks 3. The pin 4 is secured to a holding block 6, coupled to a transport chain 5. Chain 5 runs in guide rails 7. The guide elements 3 are controlled by a pin 8 from a control track 9, as seen in FIG. 4. The apparatus is similar to that described in the referenced U.S. Pat. No. 4,605,212, by the inventor hereof, and assigned to the assignee of the present application, the disclosure of which is hereby incorporated by reference.

Figure 1:
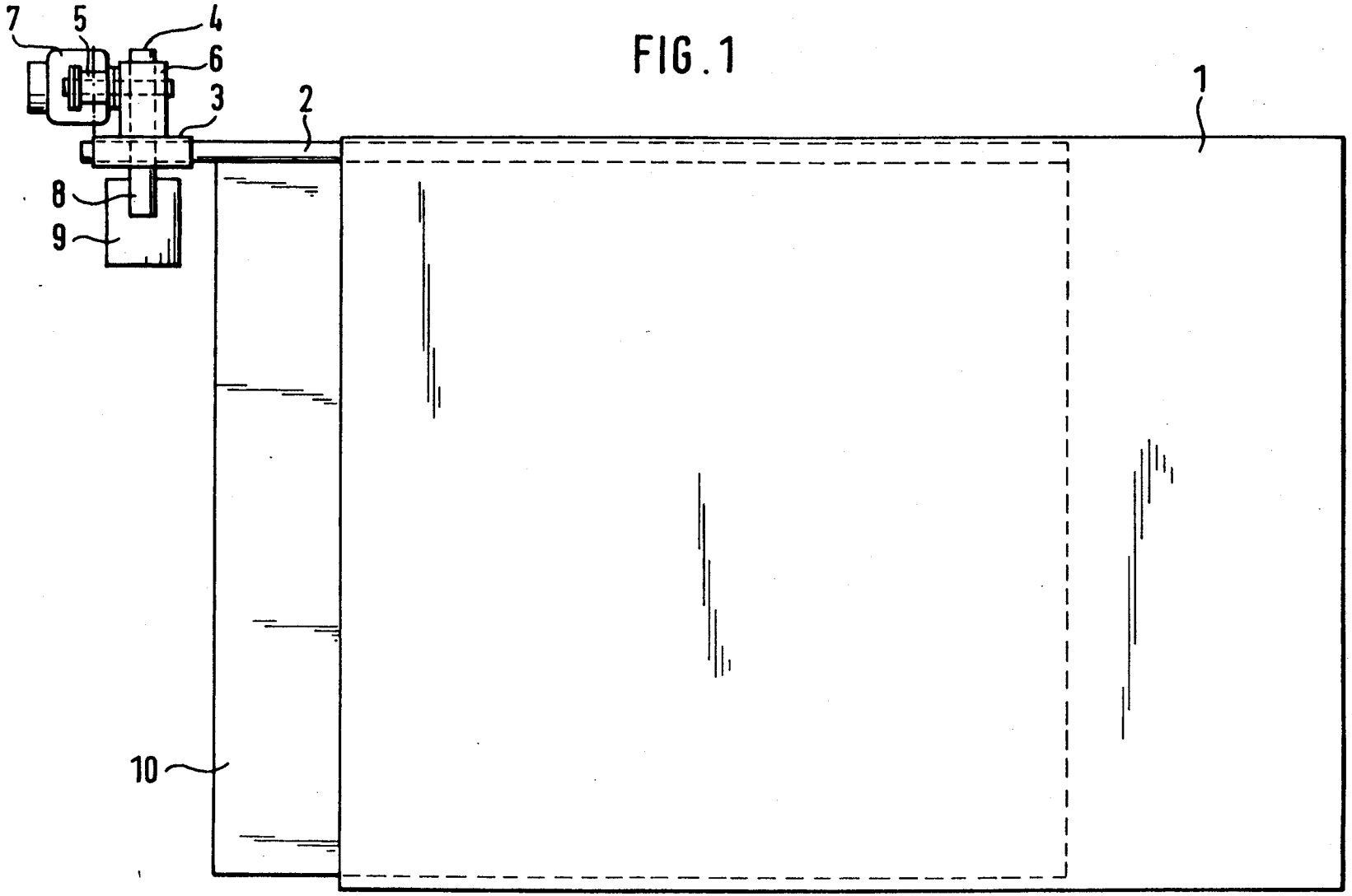
FIG. 1 is a front view of an apparatus to supply folded products to the system and apparatus in accordance with the present application.
Figure 2:
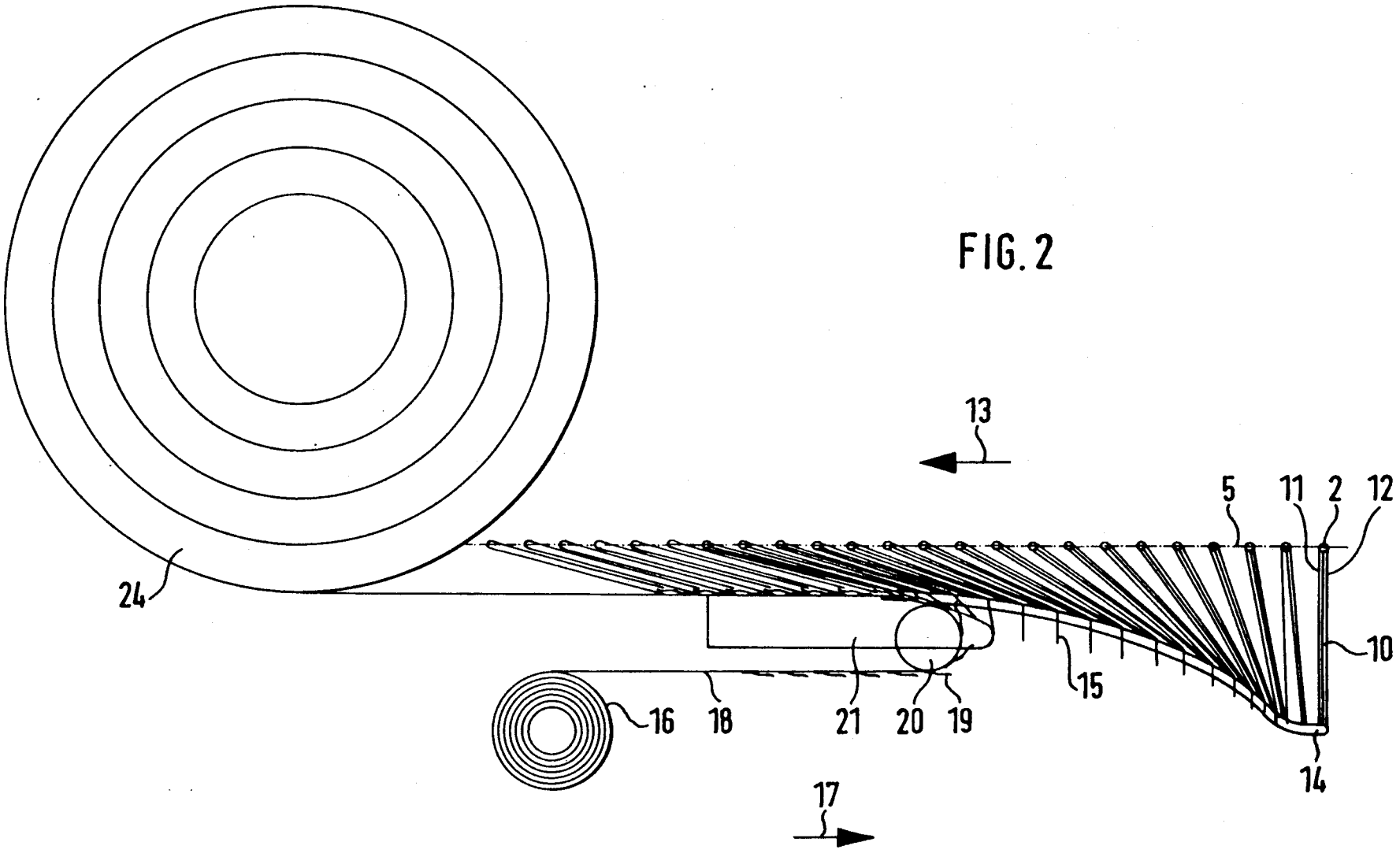
FIG. 2 is a highly schematic and diagramatic side view of a storage system and the apparatus to receive the folded products.
Figure 3:
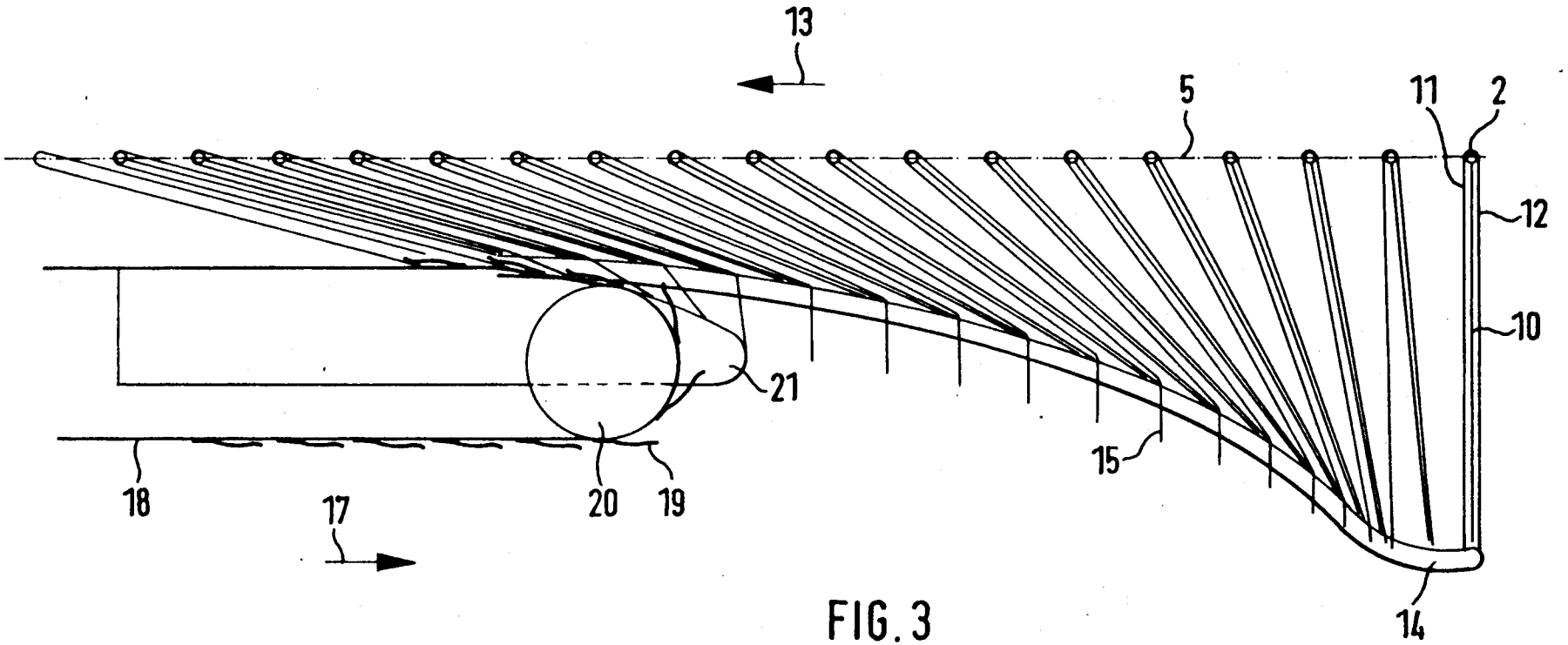
FIG. 3 is an enlarged fragmentary side view of the structure of FIG. 2.

The rods 2 have a separating sheet 10 coupled thereto which is positioned beneath the folded products 1 within the halves or sheet elements 11, 12 (see FIGS. 2, 3) of the respective folded products 1. The folded products 1 are folded over the rods 2, which act as saddles or support rods—see especially FIG. 3. Upon movement of the rods 2 by driving chain 5 in the direction of arrow 13 (FIG. 2), sheets 10 will engage against a fixed abutment or guide element 14, to be gradually moved from a vertical direction, as shown in FIG. 1, to an inclined direction, see FIGS. 3 and 5. Upon deflection of the separating sheets 10, the individual sheet elements 11, 12 of the folded products 1 will fan out to spread apart the sheet element 11, so that the folded product 1 will open. The folded products will then become positioned in shingled or imbricated form, in which only the lower part 15 of the sheet element 11 will hang down vertically, as seen in FIGS. 2 and 3, whereas the sheet element 12 will be retained against the separating element 10. This is particularly noticeable when the folded products 1 are comparatively thin. The portions 15 may not extend perfectly vertically, but may have some inclination, which is particularly the case if they are not very thin.

A transport belt 18, for example a steel belt, is drawn off a supply roller 16 (FIG. 2), and moved in the direction of the arrow 17. Holding sheets 19 are secured to the steel belt 18, for example by spot-welding. The sheets 19, which form holding and gripping sheets, have some inherent elasticity and will, besides separation, have a gripping function.

Gripping, Transport, and Storage of Products

Figure 5:
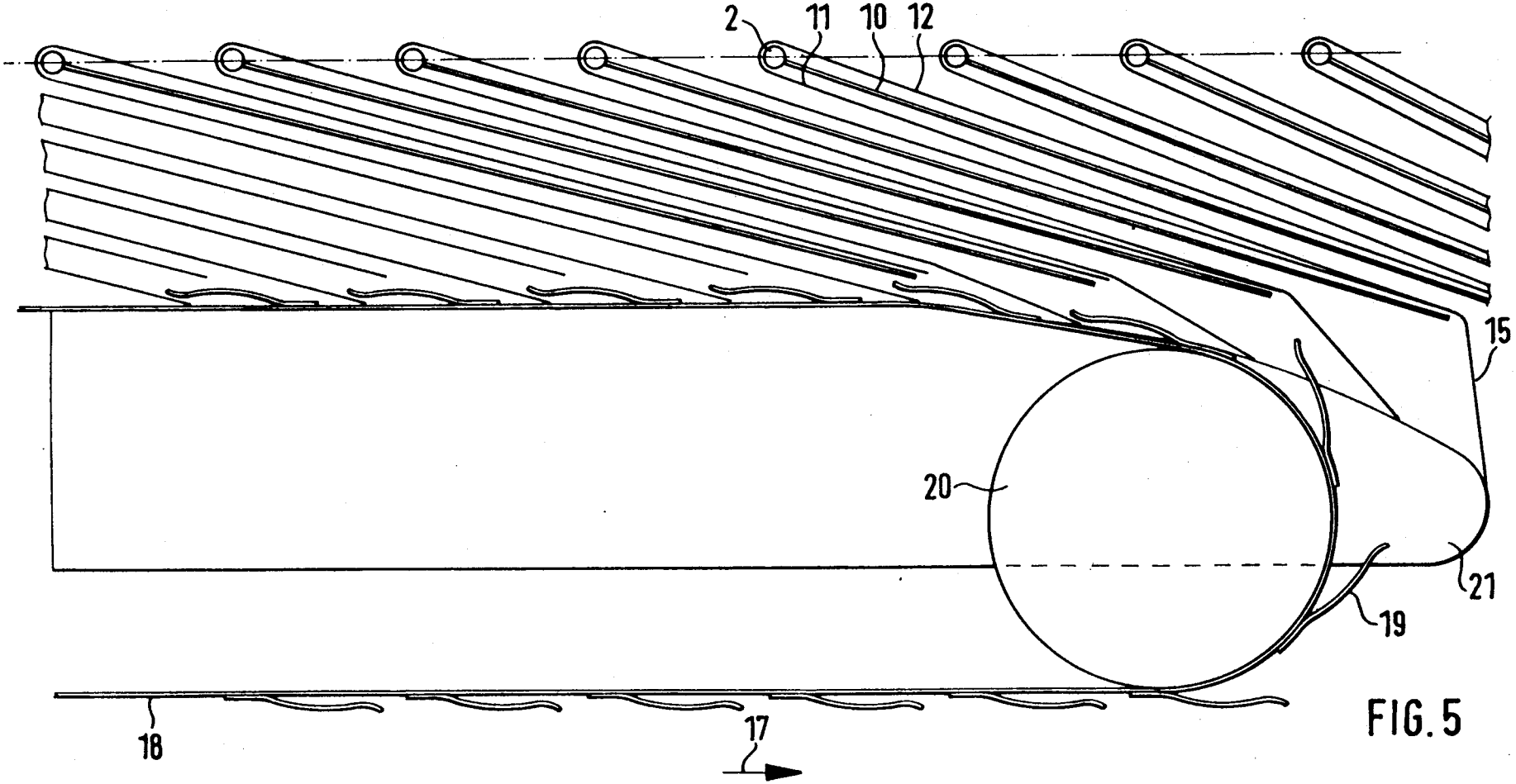
FIG. 5 is a highly enlarged side view of the product transfer portion of the system shown in FIG. 3.

Upon moving belt 18 in the direction of arrow 17, see FIG. 5, and guiding the belt 18 about a curved surface, such as a roller 20, the sheets 19 will separate from engagement with the steel belt 18 and, also, fan out to such an extent that they can engage or catch the depending portion 15 of the folded product 1. Guide strips 21 provide for guidance during this take-over and gripping operation.

Upon continued movement of the transport belt 18, the sheets 19, after being guided around the roller 20, that is, around the curved guide portion, will close similar to grippers and hold the folded products 1 on the lower sheet element 11. The holding or separating elements 19 need not be wider than the folded products 1; rather, they may be of the same size or can be substantially narrower than the folded products. As seen in FIG. 4, the rods 2, together with the separating elements 10, are guided perpendicularly to the transport plane direction 13, that is, in the direction of the arrow 22, so that they are thereby pulled laterally out from between the folded sheets 11, 12 of the folded products 1. Pulling the rods 2, together with the elements 10 laterally outwardly of the folded products is obtained by moving the chain 5 which, in turn, pulls the pin 4 on the track 9, as seen in FIG. 4. The rods 2 are guided by means of the track 23 in parallel by a pin 8 (FIG. 1). After the rods 2, together with the separating elements 10, are pulled out from the folded products 1, the steel belt 18 with the gripping sheet elements 19 can be rolled up to form a storage roll 24 (see FIG. 2). The separating sheets 19 form true separating elements between the sheet halves 11, 12 of the folded products and, in addition, grip one of the sheet elements, in this case sheet element 11, to carry out a gripping function. They permit opening of the folded products without requiring any over-folds, edge folds or the like.

It is not necessary that a storage roll 24 be formed; rather, portions of the belt 18, together with the gripping sheets 19, or belts similar to belt 18 with other types of grippers, can be stacked, flat, one above the other, similar to the stacking of flat aluminum sheets or the like. Other types of grippers than the sheets 19 may be used.

Figure 6:
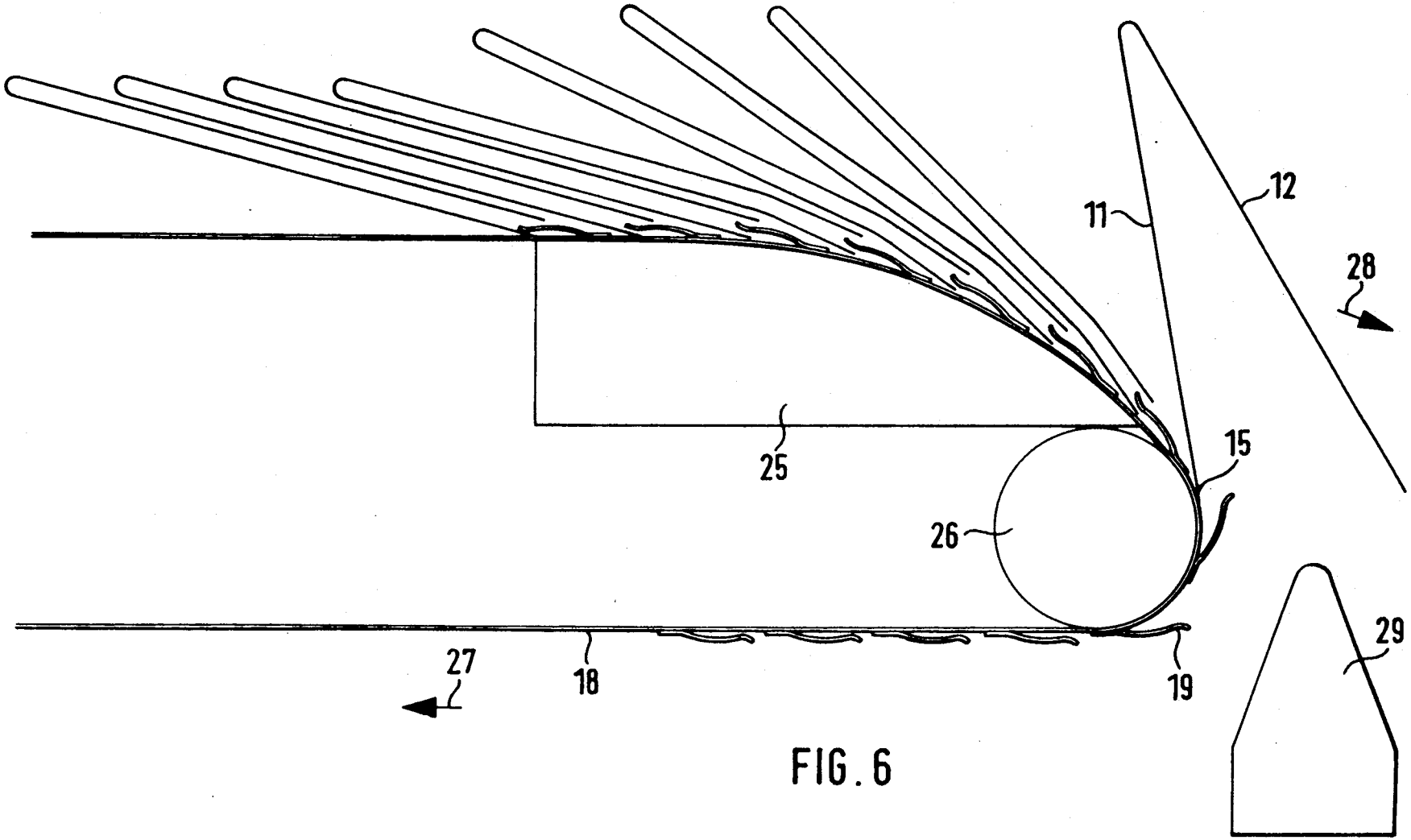
FIG. 6 is a side view of the product release portion of the system to release stored folded products, subsequent to the transfer and storage of the folded products as illustrated in connection with FIGS. 2–5.

Removal of stored Products, with reference to FIG. 6

The transport belt or tape 18 is again guided about a curved directing element, for example in form of roller 26. Before meeting the roller 26, it is guided about a curved directing sheet 25. The belt 18 moves, at the lower run, in the direction of the arrow 27, for return to a storage roll, for example the storage roll 16 (FIG. 2). The portion 15 of the sheets, as best seen in FIG. 6, is initially still retained by the gripping sheet element 19, whereas the sheet element 12, that is, the other half of the folded product 1, is moved in the direction of the arrow 28 due to centrifugal force and gravity, This opens the folded product 1, that is, the sheet elements 11, 12 fan out, see FIG. 6. This permits the folded products 1 to be placed on a holding saddle 29, or other similar structure. The holding saddle 29 may be part of a supply chain to a stapling machine or the like.

Folded products 1, as described above, can be transferred to the belt 18, stored, and released from the belt, while being spread apart for subsequent further handling. No over-folds or extra folds are necessary, which is a substantial saving in paper; such over-folds, in prior art structures, had to be cut off in a subsequent, later operating step.

The embodiment of the invention illustrated in the example shows that the belt 18 is guided about rollers 20, 26. It is not necessary that these curved guide structures or the curve directing structures are rollers; other types of curved guide or directing structures are possible, with the only requirement that they are so shaped that the sheets 19, which have a gripping function, open and spread apart from the belt 18 to which they are secured, In equivalent manner, the gripper elements 19 need not be flat sheets, or sheets with a slight offset, as shown in FIG. 6; they may also be gripper elements, for example with projecting pins or tongues, which open and close under control of suitable control means, for example a cam track adjacent the curved guide and/or directing structure, an electromagnet or the like.

The specification has referred to folded products 1, having folded sheets 11, 12; the folded products need not be single-ply elements, but may have more than one sheet folded above each other, so that when reference is made to "sheets 11, sheets 12", these may be a group of parallel sheets, forming part of an assembly of folded-over sheets, and placed on top of each other.

Various changes and modifications may be made within the scope of the inventive concept.

I claim:

1. A system for reception, loading for storage and subsequent removal and transfer of folded sheet products (1) defining essentially parallel adjacent sheet elements (11, 12), particularly printed products, comprising a storage means (24);

a first subsystem for the reception of the sheet product (1) and loading said sheet product on the storage means (24), and a second subsystem for receiving the storage means with the sheet product thereon and unloading the sheet product from said storage means, wherein said storage means (24) comprises a selectively reversibly driven transport belt means (18);

a plurality of connected essentially flat separating means (19) retained on said transport belt means (18) and holding the separating means in coupled, connected relation along a longitudinal portion of the transport belt means;

wherein said first subsystem comprises curved guide means (20), said transport belt means, with the separating means thereon, when operating in a first direction (17) being passed about said curved guide means to thereby fan out or spread out the separating means (19) from the transport belt means;

means (5, 14) for spreading apart the folded product to thereby separate the sheet elements (11, 12), said spreading means and said curved guide means being positioned with respect to each other to cause the separating means (19) as they fan out, upon movement of the transport belt means (18), to enter between the spread-apart sheet elements (11, 12), said separating means, upon subsequent engagement with the transport belt means, forming a gripper arrangement for the folded products by gripping one (11) of the sheet elements between the separating means (19) and the transport belt means (18); and wherein said second subsystem comprises curved directing means (26; FIG. 6) positioned for engagement with the transport belt means, upon operation of the transport belt means (18) in reverse direction (27), spreading that one (12) of the sheet elements which was not gripped between the separating means and the transport belt means away from the gripped sheet elements (11) for release of the gripped sheet elements and unloading of the sheet products (1) from said transport belt means (18).

2. The system of claim 1, wherein said curved guide means (20) comprises a roller.

3. The system of claim 1, wherein said curved directing means (26) comprises a roller.

4. The system of claim 1, wherein said curved guide means (20) and said curved directing means (26) comprise a roller means.

5. The system of claim 1, wherein said transport belt means (18) comprises a metallic elongated belt element;

and wherein the separating means (19) comprise sheet metal elements secured to the metallic belt (18).

6. The system of claim 1, wherein said first subsystem further includes a guide surface (21) located adjacent the curved guide means (20) for guiding said folded products (13) upon being gripped between said separating means and the transport belt means.

7. The system of claim 1, wherein said second subsystem further includes a curved guide element (25) positioned adjacent the curve directing means (26) for guiding the transport belt means (18) with the gripped sheets and the separating means towards said directing means.

8. The system of claim 1, further including a supply system having a plurality of essentially horizontally positioned support rods (2);

means (5) for connecting said support rods, one behind the other, the support rods engaging the folded products behind the folds thereof;

and guide track means (5) guiding said connecting means in a path close to said curved guide means (20) and in position to permit the separating means (19) to enter between the sheet elements (11, 12) of the folded products, said guide track means (5) guiding the connecting means laterally away from said path after transfer of the folded products to the separating means and said transport belt means (18) to thereby pull out the support rods (2) from beneath the fold of the folded products as they are being transferred to and gripped by said separating means (19) and the transport belt means.

9. The system of claim 8, including separating plates (10) secured to said essentially horizontally positioned support rod (2), said separating plates being engageable by said spreading means (5, 14) and deflectable thereby from an essentially vertical position to spread apart the sheet elements (11, 12) of the folded products.

10. The system of claim 1, wherein said transport belt means (18) after a plurality of folded products are gripped thereon by said separating means (19) forms said storage means; and said transport belt means is rolled into a roll to form a folded product storage roll (24).

11. The system of claim 1, wherein said transport belt means (18) comprises an elongated belt element; and wherein the separating means (19) comprise sheet elements secured to the elongated belt element (18), and selectively positionable against said belt element, with or without a sheet element therebetween, or fanned out from the belt element.

12. The system of claim 10, wherein said transport belt means (18) comprises an elongated belt element; and wherein the separating means (19) comprise sheet elements secured to the elongated belt element (18), and selectively positionable against said belt element, with or without a sheet element therebetween, or fanned out from the belt element.

13. The system of claim 10, wherein said transport belt means (18) comprises a metallic elongated belt element;

and wherein the separating means (19) comprise sheet metal elements secured to the metallic belt element (18).

* * * * *